US007080455B1

(12) United States Patent
Ronan et al.

(10) Patent No.: US 7,080,455 B1
(45) Date of Patent: Jul. 25, 2006

(54) HANDHELD KITCHEN SCISSOR/KNIFE APPLIANCE

(75) Inventors: John S. Ronan, Temecula, CA (US); Richard A. Kluender, Temecula, CA (US)

(73) Assignee: Ronan Tools, Inc., San Jacinto, CA (US)

( * ) Notice: Subject to any disclaimer, the term of this patent is extended or adjusted under 35 U.S.C. 154(b) by 0 days.

(21) Appl. No.: 10/408,083

(22) Filed: Apr. 3, 2003

Related U.S. Application Data

(63) Continuation-in-part of application No. 10/021,479, filed on Nov. 30, 2001, now Pat. No. 6,698,099.

(51) Int. Cl.
*B26B 11/00* (2006.01)

(52) U.S. Cl. ..... 30/122; 30/146; 30/254

(58) Field of Classification Search ..... 30/122, 30/146, 254, 259, 266, 340, 341, 342, 145; 81/415, 407, 409.5, 411, 417
See application file for complete search history.

(56) References Cited

U.S. PATENT DOCUMENTS

| | | | | | |
|---|---|---|---|---|---|
| 568,010 | A * | 9/1896 | Wilkins | 30/186 |
| 936,390 | A * | 10/1909 | Washburn | 30/254 |
| 1,133,753 | A * | 3/1915 | Shortridge | 30/122 |
| 1,301,753 | A * | 4/1919 | Seniw | 42/90 |
| 1,303,277 | A * | 5/1919 | Federkiewicz | 30/146 |
| 1,688,729 | A * | 10/1928 | Mead | 81/413 |
| 2,083,483 | A * | 6/1937 | Strezoff | 30/270 |
| 2,674,796 | A * | 4/1954 | Herold | 30/262 |
| 3,680,212 | A * | 8/1972 | Rozmus | 30/266 |
| 3,835,533 | A * | 9/1974 | Granson | 30/146 |
| 3,949,474 | A * | 4/1976 | Sandbrook et al. | 30/260 |
| 4,805,305 | A * | 2/1989 | Davis | 30/258 |
| 4,809,433 | A * | 3/1989 | Maxwell et al. | 30/254 |
| 5,255,438 | A * | 10/1993 | Morgan | 30/254 |
| 5,379,521 | A * | 1/1995 | Lynders | 30/233 |
| 5,469,625 | A * | 11/1995 | Melter et al. | 30/251 |
| 5,625,951 | A * | 5/1997 | Hamlin | 30/146 |
| 5,625,952 | A * | 5/1997 | Thomas | 30/262 |
| 5,810,865 | A * | 9/1998 | Koscher et al. | 606/174 |
| 5,815,866 | A * | 10/1998 | Janky | 7/114 |
| 6,000,307 | A * | 12/1999 | Aamodt | 83/13 |
| 6,116,124 | A * | 9/2000 | Ping | 81/385 |
| 6,260,279 | B1 * | 7/2001 | Apolinski et al. | 30/341 |
| 6,625,888 | B1 * | 9/2003 | Heck et al. | 30/186 |
| 6,658,967 | B1 * | 12/2003 | Rutkowski et al. | 76/106.5 |

* cited by examiner

*Primary Examiner*—Timothy V. Eley
*Assistant Examiner*—Omar Flores Sánchez
(74) *Attorney, Agent, or Firm*—Loyal McKinley Hanson

(57) ABSTRACT

A cutting apparatus includes first and second subassemblies. The first subassembly has a first handle and a blade connected to the first handle, the blade including a proximal end portion attached to the handle, a distal end portion, and a cutting edge intermediate the proximal and distal end portions. The second subassembly has a second handle and an anvil with a knife-opposing surface. The first and second subassemblies are adapted to be manually assembled pivotally together to form a blade-and-anvil cutters and to be manually unsnapped to enable independent use of the first subassembly as a knife. The action of a user squeezing the first and second handles toward each other causes the knife-opposing surface of the anvil and the cutting edge of the blade to move toward each other in order to cut an object positioned intermediate the knife-opposing surface and the cutting edge.

5 Claims, 7 Drawing Sheets

HANDHELD KITCHEN SCISSOR/KNIFE APPLIANCE

CROSS REFERENCE TO RELATED APPLICATION

This application is a continuation in part of U.S. patent application Ser. No. 10/021,479 filed Nov. 30, 2001 now U.S. Pat. No. 6,698,099.

BACKGROUND OF THE INVENTION

1. Technical Field

This invention relates generally to knives and other cutters, and more particularly to a multifunction handheld kitchen scissor/knife appliance that can be configured when desired for use as a conventional fixed-blade knife and as a blade-and-anvil cutters.

2. Description of Related Art

A conventional fixed-blade knife is a cutting tool having a blade and a handle attached to the blade. The blade has an edge (a cutting edge) that extends from the handle end of the blade (the proximal end portion) toward the tip of the blade (the distal end portion), and a spine (the top of the blade) opposite the cutting edge that also extends from the handle end of the blade toward the tip of the blade. The spine of the blade is typically somewhat broad (at least near the handle the end) so that a user can push against it with his thumb in order to facilitate cutting with the edge of the blade. Hunting knives and kitchen knives are good examples.

Whether in the field, in the kitchen, or elsewhere, some cuts are better made with a blade-and-anvil type of cutters (i.e., a cutting tool having a blade that closes and cuts against an anvil). The blade-and-anvil cutters in U.S. Pat. Nos. D398,499, D434,955, D422,463, and D427,036 provide good examples. But, a second tool is required and so it is desirable to have a better way to accomplish these two different types of cutting.

The invention described in the parent application addresses the concerns outlined above by providing a convertible knife that can be used for both types of cutting. The convertible knife includes a knife member and a companion conversion member that locks onto the knife member when desired. Preferably, at least a portion of the spine of the knife is sharpened to provide a secondary cutting edge, and the conversion member locks onto the knife member pivotally to provide an anvil member that works in opposition to the secondary cutting edge. Thus, the user can quickly convert between knife stye cutting and blade-and-anvil cutting by adding or removing the conversion member. Nevertheless, refinement is desirable for food preparation purposes, in the kitchen or elsewhere.

SUMMARY OF THE INVENTION

The invention of this continuation-in-part application addresses the needs outlined above by providing a handheld kitchen scissor/knife appliance (i.e., a cutting apparatus) that includes a knife subassembly and an anvil subassembly. The two subassemblies are so constructed that they assemble together to form a blade-and-anvil cutting tool configured for food preparation purposes. They disassemble to enable use of the knife subassembly as a conventional fixed-blade knife.

To paraphrase some of the more precise language appearing in the claims and introduce the nomenclature used, a cutting apparatus constructed according to the invention includes first and second subassemblies. The first subassembly has a first handle and a blade connected to the first handle, the blade including a proximal end portion attached to the handle, a distal end portion, and a cutting edge intermediate the proximal and distal end portions. The second subassembly has a second handle and an anvil connected to the second handle. The first and second subassemblies are adapted to be manually snapped together to form a blade-and-anvil cutters and to be manually unsnapped to enable independent use of the first subassembly as a knife. The action of a user squeezing the first and second handles toward each other in the assembled configuration causes the knife-opposing surface of the anvil and the cutting edge of the blade to move toward each other in order to cut an object positioned intermediate the knife-opposing surface and the cutting edge.

Thus, the invention of this continuation-in-part application further refines the convertible knife concept described in the parent application to provide a handheld kitchen scissor/knife appliance for food preparation purposes. The following illustrative drawings and detailed description make the foregoing and other objects, features, and advantages of the invention more apparent.

DESCRIPTION OF THE PREFERRED EMBODIMENTS

Figure 1:
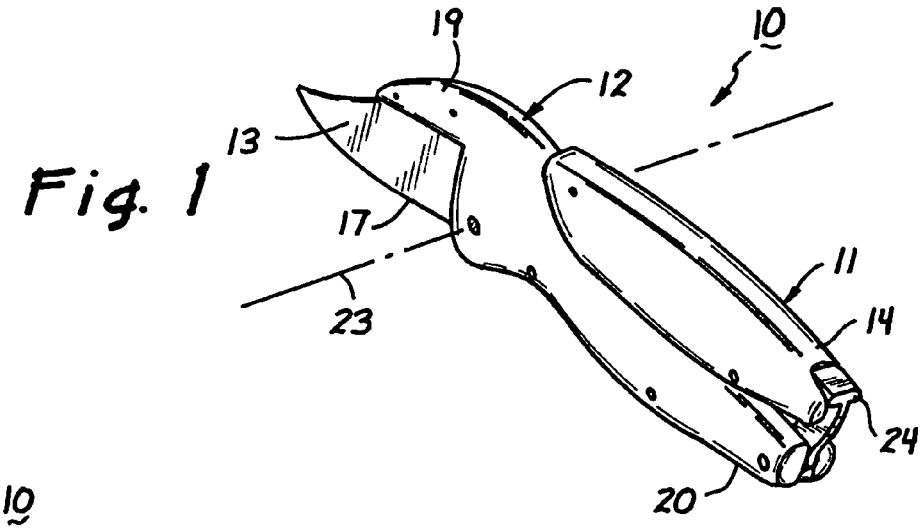
FIG. 1 of the drawings is a perspective view of a convertible knife constructed according to the parent application invention, shown in a closed configuration with the blade closed against the anvil.
Figure 2:
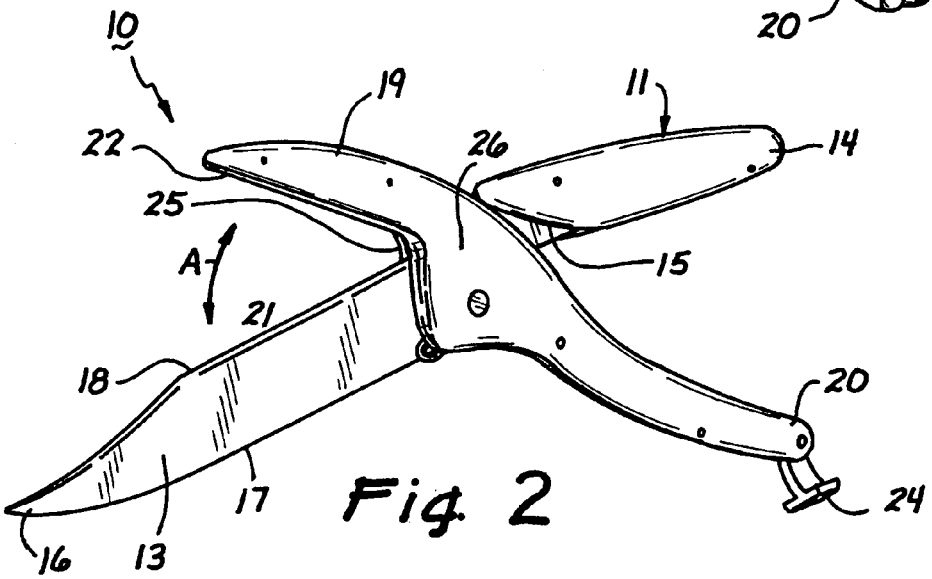
FIG. 2 is another perspective view of the convertible knife shown in an open configuration, with the blade spaced apart from the anvil.
Figure 3:
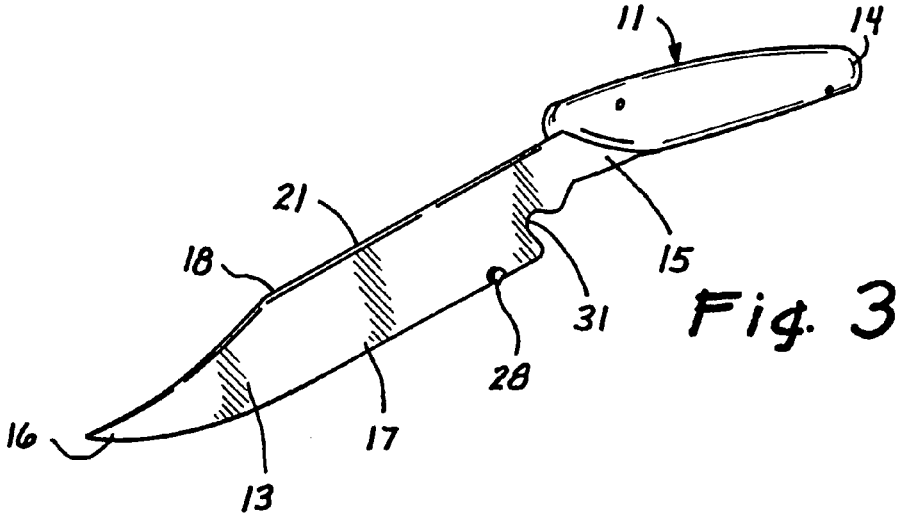
FIG. 3 is a perspective view of just the knife of the convertible knife.
Figure 5:
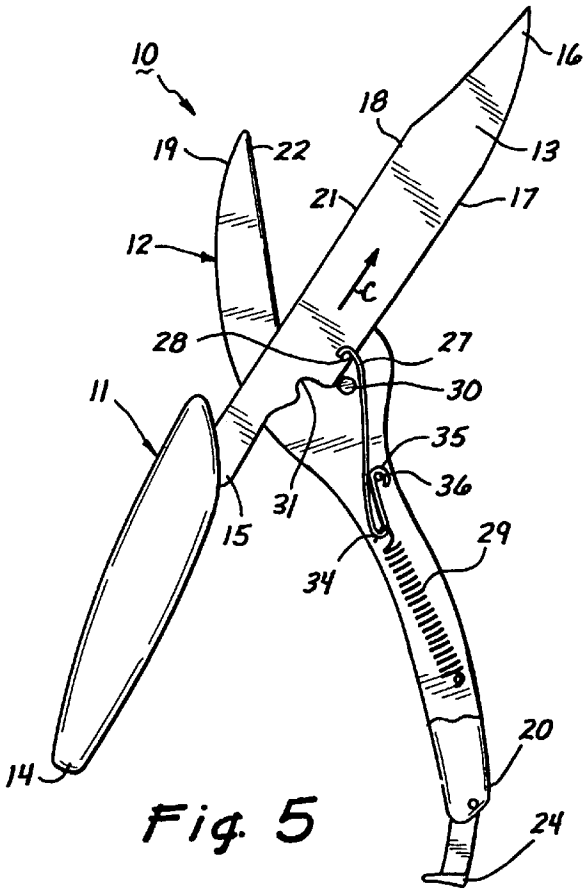
FIG. 5 is a plan view that shows engagement of the recess on the blade of the knife by the hook component.

The following description proceeds by restating the description contained in the parent application (Ser. No. 10/021,479 filed Nov. 30, 2001. It is presented with reference to FIGS. 1–11 as background information in the following Convertible Knife section of the specification. Thereafter follows a description of the preferred embodiments of the present invention of this continuation-in-part application in a Handheld Kitchen Scissor/Knife Appliance section of the specification. It is presented with reference to FIGS. 12–17. A reader already familiar with the information described in the parent application can skip directly to the Handheld Kitchen Scissor/Knife Appliance section.

Convertible Knife. FIGS. 1–9 of the drawings show various aspects of a convertible knife assembly 10 constructed according to the invention of the parent application. Generally, the convertible knife assembly 10 includes a knife 11 (FIGS. 1–7) and a conversion piece 12 (FIGS. 1–6 and 9). Those two components assemble together to form the convertible knife assembly 10.

Focusing first on the nomenclature used in the parent application, the knife 11 has a blade 13 (FIGS. 1–9) and a handle 14. The blade 13 includes a handle end 15 (i.e., a proximal end portion) that is attached to the handle 14, a tip 16 (i.e., a distal end portion) opposite the handle end 15, a cutting edge 17 intermediate the handle end 15 and the tip 16, and a spine 18 intermediate the handle end 14 and the tip 16 that is disposed opposite the cutting edge 17.

The knife 11 may be similar in many respects to existing fixed-blade knives, with the spine 18 sometimes being referred to as the top of the blade 13. The blade 13 of the illustrated knife 11 is about 5.5 inches to 6.0 inches long and is composed of steel, while the handle 14 is about 4.0 inches long and composed of plastic. Of course, those details can vary significantly within the scope of the claims and the inventive concepts disclosed.

The conversion piece 12 (e.g., a 7.5 inch long plastic piece) includes a spine-opposing portion 19 and a handle portion 20. It is adapted to be mounted on the knife 13 pivotally with the spine-opposing portion 19 opposing the spine 18 of the blade 13 and the handle portion 20 opposing the handle 14 of the knife 13. The action of a user squeezing the handle portion 20 of the conversion piece 12 and handle 14 of the knife 13 toward each other causes the spine-opposing portion 19 of the conversion piece 12 and the spine 18 of the blade 13 to move toward each other as depicted by an arrow A in FIG. 2. That action results in the spine-opposing portion 19 and the spine 18 bearing against an object the user positions between the spine-opposing portion 19 and the spine 18 of the blade 13.

For blade-and-anvil cutting purposes, at least a portion of the spine 18 of the blade 13 (e.g., about two inches long) is sharpened to form a secondary cutting edge 21 (FIGS. 2–7 and 9). In addition, the spine-opposing portion 19 has a shape that forms an anvil facing the secondary cutting edge 21. It forms an anvil in the sense that it includes a surface 22 (e.g., about two inches long) facing the secondary cutting edge 21 in order to enable blade-and-anvil cutting of an object positioned intermediate the secondary cutting edge 21 and the surface 22. Cutting occurs as the spine-opposing portion 19 of the conversion piece 12 and the spine 18 of the blade 13 move toward each other. Pivotal movement is about a pivotal axis of rotation 23 shown in FIG. 1 as depicted by the arrow A in FIG. 2.

For independent use of the knife 11 apart from the conversion piece 12, the user first manipulates a locking member 24 (FIGS. 4–7) on the handle portion 20 of the conversion piece 12. The locking member 24 is adapted to engage the handle 14 of the knife 11 in order to lock the convertible knife 10 in the close configuration illustrated in FIG. 1. The user manipulates the locking member 24 (i.e., pivots it) in order to disengage it from the handle 14 and thereby enable movement of the knife 11 and conversion piece 12 to the open configuration illustrated in FIG. 2. Then, the user withdraws the knife 11 from the conversion piece 12 so that the knife 11 can be used independent of the conversion piece 12 as suggested by FIG. 3. More specifically, he withdraws the knife 11 from a channel 25 (FIGS. 2 and 9) formed by a mid portion 26 of the conversion piece 12.

Figure 4:
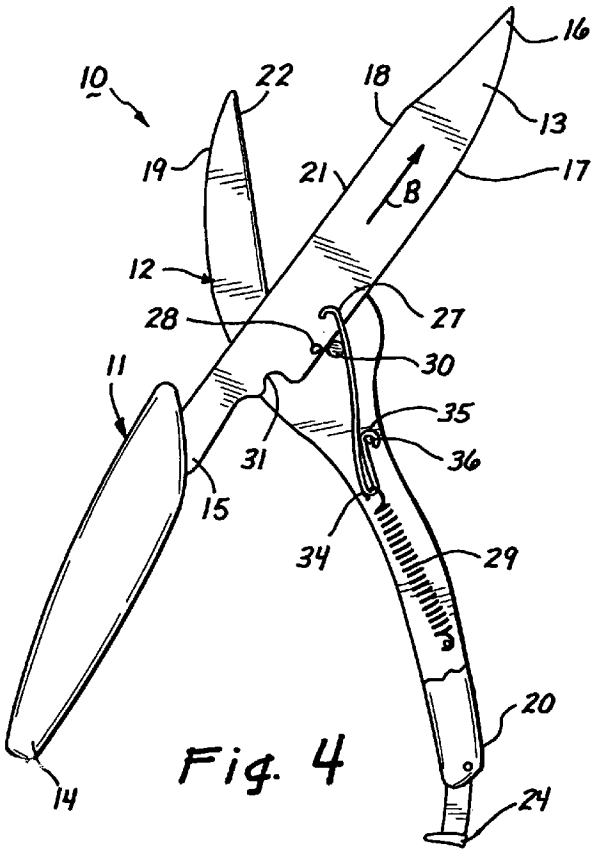
FIG. 4 is an enlarged plan view of the convertible knife showing an initial step in the procedure of assembling the knife and the conversion piece, with portions of the conversion piece broken away to expose the hook component and the spring component of the conversion piece.
Figure 7:
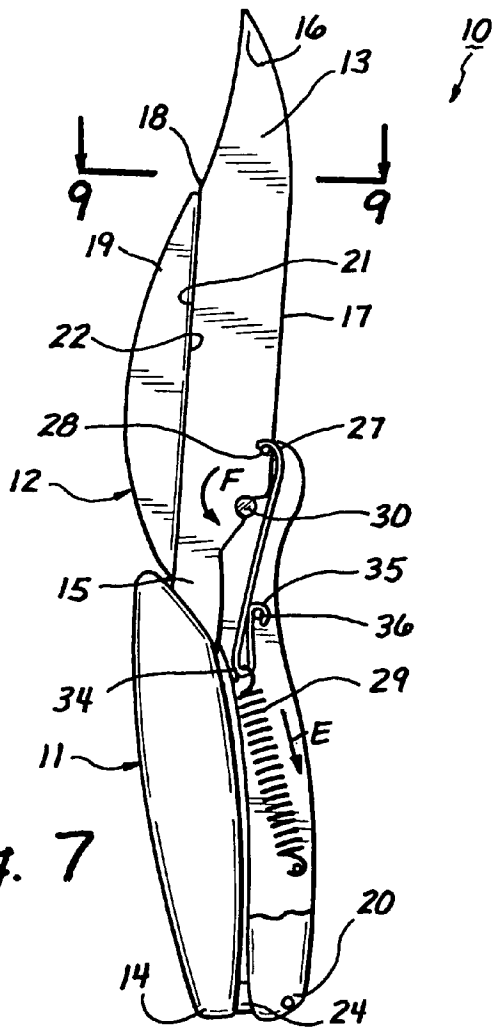
FIG. 7 is a plan view that shows the knife and the conversion piece completely assembled and in the closed configuration.
Figure 6:
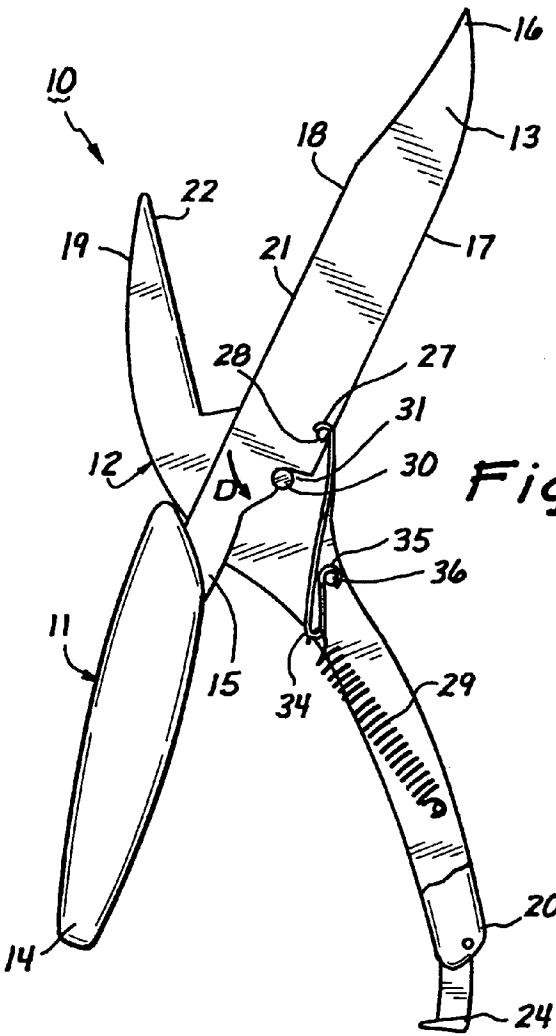
FIG. 6 is a plan view that shows the pivot pin on the conversion piece seating in the recess in the blade of the knife.

To reassemble the knife 11 and the conversion piece 12 back into the convertible knife 10, the user inserts the blade 13 of the knife 11 through the channel 25 as depicted by an arrow B in FIG. 4. As he continues to advance the blade 13 as depicted by an arrow C in FIG. 5, a hook member 27 on the conversion piece 12 engages a pin 28 protruding out of the blade 13. A spring 29 connected to the hook member 27 spring biases the hook member so that the hook member 27 pulls the blade 13 back toward a pivot pin 30 as depicted by an arrow D in FIG. 6. As that occurs, the pivot pin 30 seats in a pin-receiving recess 31 in the blade 13, where it is held by action of the hook-and-spring assembly formed by the hook member 27 and the spring 29, as depicted by an arrow E in FIG. 7. After that, the user pivots the knife 11 and conversion piece 12 to the closed configuration as depicted by an arrow F in FIG. 7, and then he manipulates the locking member 24 so that it engages the handle 14 and thereby locks the convertible knife 10 in the closed configuration.

Figure 8:
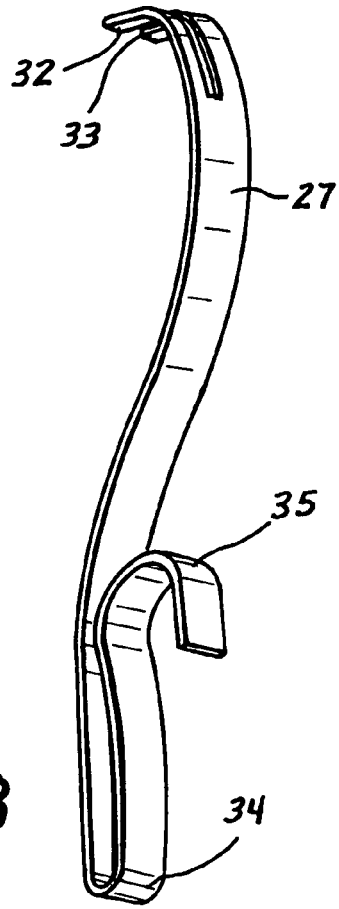
FIG. 8 is an enlarged view of the hook component.

FIG. 8 is an enlarged view of the hook component 27. It is a metal strip that includes spaced-apart, pin-engaging fingers 32 and 33 that fit on opposite sides of the blade 13 adjacent the pin 28. The spring 29 attaches to a spring-engaging portion 34 of the hook member 27, while a curved end 35 of the hook member 27 fits over a retaining pin 36 that is visible in FIGS. 4–7. Based upon the foregoing and subsequent descriptions, one of ordinary skill in the art can readily implement a convertible knife within the scope of the claims.

Figure 9:
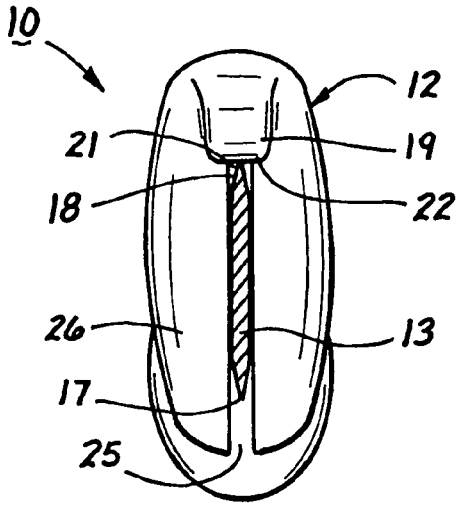
FIG. 9 is a cross sectional view of the convertible knife as viewed in a transverse plane containing a line 9—9 in FIG. 7.
Figure 9A:
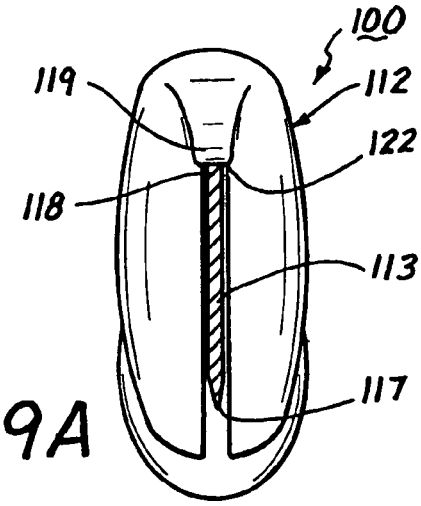
FIG. 9A is a cross sectional view of a second embodiment of the parent application invention that is adapted for use as a crimping tool.

FIG. 9A shows another convertible knife 100 constructed according to the parent application invention. It is similar in many respects to the convertible knife 10 and so only differences are described in further detail. For convenience, numerals designating parts of the convertible knife 100 are increased by one hundred over those designating corresponding or related parts of the convertible knife 10.

Similar to the convertible knife 10, the convertible knife 100 includes a conversion piece 112 having a spine-opposing portion 119 with a surface 122. It also includes a blade 113 with a cutting edge 117. However, the spine 118 of the blade 113 is not sharpened. That arrangement adapts the convertible knife 100 to use as a crimping tool. The spine-opposing portion 119 of the conversion piece 112 has a shape that forms a dull edge facing the spine of the blade (i.e., the surface 122) in order to enable crimping of an object. The user crimps the object between the spine 118 and the surface 122.

Figure 9B:
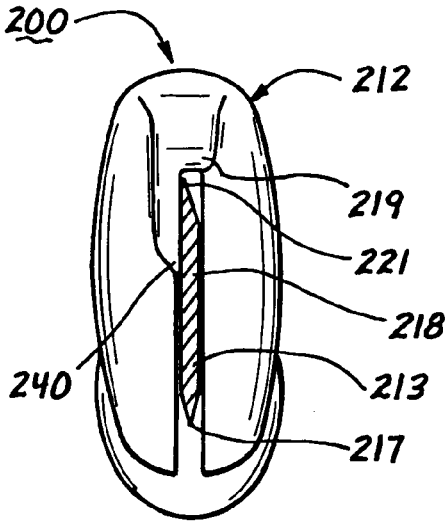
FIG. 9B is a cross sectional view of a third embodiment of the parent application invention that is adapted for use as a shears.

FIG. 9B shows yet another convertible knife 200 constructed according to the parent application invention. It is also similar in many respects to the convertible knife 10 and so only differences are described in further detail. For convenience, numerals designating parts of the convertible knife 200 are increased by two hundred over those designating corresponding or related parts of the convertible knife 10.

Similar to the convertible knife 10, the convertible knife 200 includes a conversion piece 212 having a spine-opposing portion 219. It also includes a blade 213 having a cutting edge 217 and a sharpened spine 218 that forms a secondary cutting edge 221. Unlike the convertible knife 10, however, the spine-opposing portion 219 of the conversion piece 212 does not form an anvil. Instead, the spine-opposing portion 219 has a shape that forms a conversion piece cutting edge 240 opposing the secondary cutting edge 221 of the blade 213 in order to enable shears-type cutting of an object. The user cuts the object by shears action of the conversion piece cutting edge 240 and the secondary cutting edge 221 of the blade 213.

Figure 10:
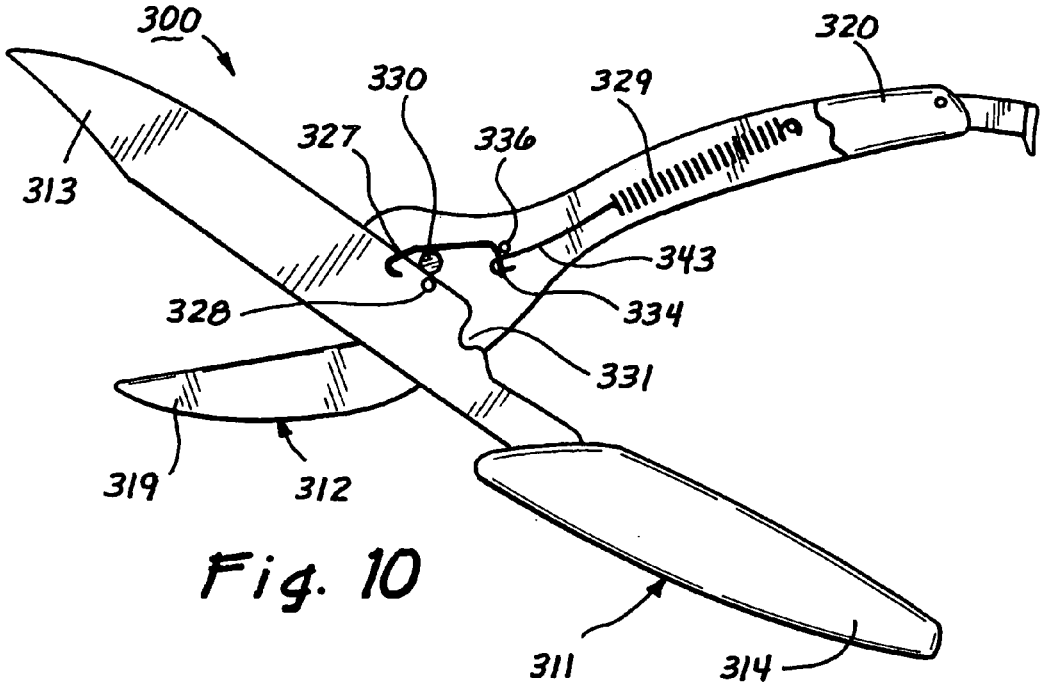
FIG. 10 is a plan view (similar to FIG. 4) of a fourth embodiment of the parent application invention having a different second hook component and different second spring component that form a different hook-and-spring assembly.
Figure 11:
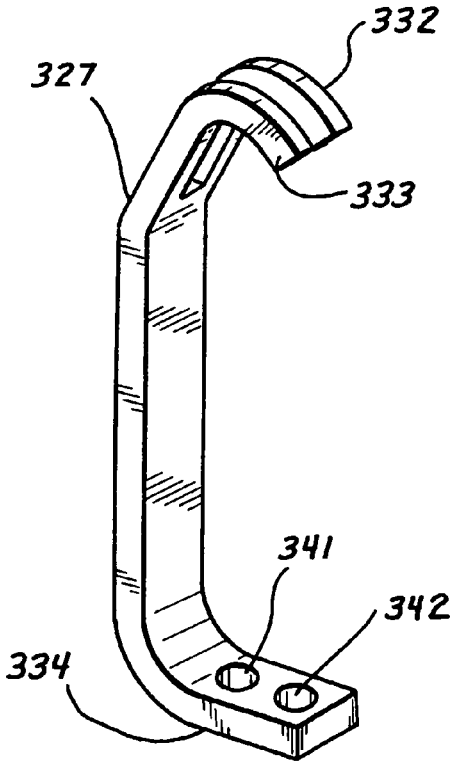
FIG. 11 is an enlarged view (similar to FIG. 8) of just the second hook component.
Figure 12:
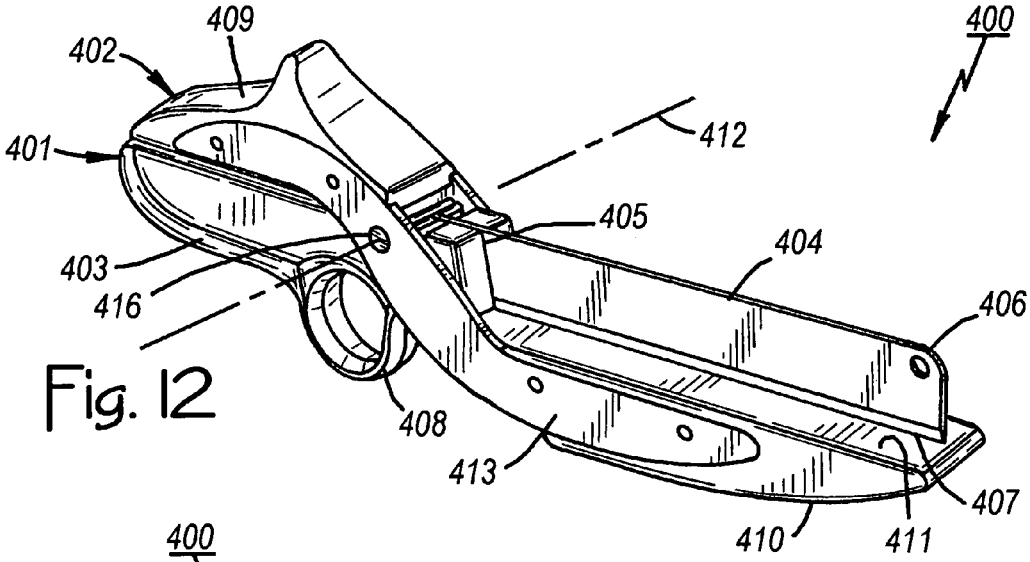
FIG. 12 of the drawings is an isometric view of a handheld kitchen scissor/knife appliance constructed according to the invention of this continuation-in-part application.

Turning now to FIGS. 10 and 11, they show a convertible knife 300 constructed according to the parent application invention that includes a different hook member. The convertible knife 300 is otherwise similar in many respects to the convertible knife 10 and so only differences are described in further detail. For convenience, numerals designating parts of the convertible knife 300 are increased by three hundred over those designating corresponding or related parts of the convertible knife 10.

Similar to the convertible knife 10, the convertible knife 300 includes a knife 311 having a blade 313 and a handle 314. It also includes a conversion piece 312 having a spine-opposing portion 319 and a handle portion 320. Those two components assemble together to form the convertible knife 300. A hook member 327 and a spring 329 combine to form a hook-and-spring assembly that engages a pin 328 on the blade 313 to hold a pivot pin 330 within a recess 331 in the blade 313. Instead of a curved end of the hook member engaging a retaining pin 336 in the manner of the curved end 35 of the hook member 27, the spring-engaging portion 334 of the hook member 327 is L-shaped and provided with two holes 341 and 342 (FIG. 11) for receiving a U-shaped end portion 343 of the spring 329 (FIG. 10), so that the spring-engaging portion 334 rests against the retaining pin 336 as illustrated in FIG. 10. The U-shaped end portion 343 slides against the retaining pin 336 during assembly and disassembly of the convertible knife 300. This arrangement facilitates fabrication and operation of the conversion piece 312.

Handheld Kitchen Scissor/Knife Appliance. Turning now to FIGS. 12–17 of the drawings, they show various aspects of a handheld kitchen scissor/knife appliance 400 constructed according to the invention of this continuation-in-part application. Generally, the appliance 400 is a cutting apparatus or assembly that includes a first subassembly in the form of a knife subassembly 401 and a second subassembly in the form of an anvil subassembly 402. The knife subassembly 401 includes a first handle 403 and a blade 404 connected to the first handle 403. The blade 404 includes a proximal end portion 405 attached to the first handle 403, a distal end portion 406, and a straight cutting edge 407 intermediate the proximal and distal end portions 405 and 406. The first handle 403 includes a finger-receiving loop 408 into which the user places their index finger for a better grip and for finger protection.

The anvil subassembly 402 includes a second handle 409 and an anvil-defining structure in the form of an anvil 410 connected to the second handle 409. The anvil 410 is a component (preferably somewhat resiliently deformable) that defines a knife-opposing flat surface 411. Cutting of an object positioned intermediate the cutting edge 407 and the surface 411 (object not shown) occurs as the cutting edge 407 and the surface 411 move toward each other. In other words, the action of a user squeezing the first and second handles 403 and 409 toward each other causes the knife-opposing surface 411 and the cutting edge 407 to move toward each other in order to bear against an object the user positions between them.

The knife subassembly 401 and the anvil subassembly 402 are adapted to be assembled together manually by a user to form a blade-and-anvil cutters in the form of the cutting apparatus 400, and to be disassembled manually to enable use of the knife subassembly 401 separately, without the anvil subassembly 402. The subassemblies 401 and 402 snap together so that they pivot relative to each other about a pivotal axis 412 shown in FIG. 12. For the illustrated cutting apparatus 400, the anvil subassembly 402 includes spaced apart first and second anvil-mounting members 413 and 414 (e.g., flat metal brackets) that connect the anvil 410 to the second handle 409 while defining a blade-receiving opening 415 (FIG. 13) intermediate the second handle 409 and the anvil 410 for receiving the first subassembly 401.

Figure 15:
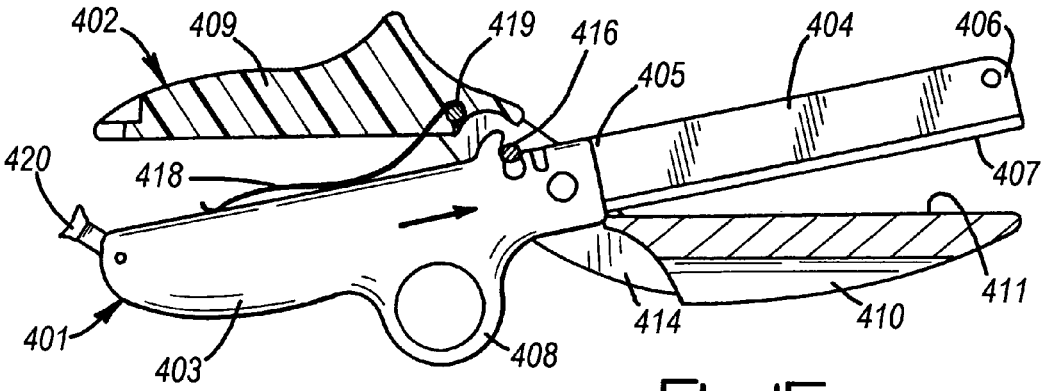
FIG. 15 is a side elevation view of the blade subassembly as it is being mounted on the anvil subassembly.
Figure 16:
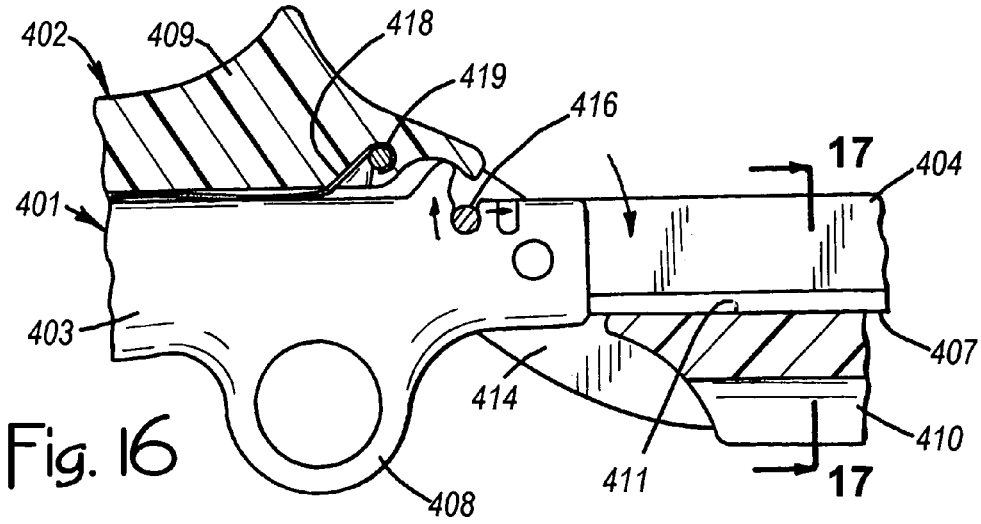
FIG. 16 is an enlarged side elevation view of a portion of the blade subassembly as it is locked into place on the anvil subassembly.

The knife subassembly 401 is adapted to snap into pivotal engagement of the anvil subassembly 402 when the knife subassembly 401 is advanced into the blade-receiving opening 415. The user inserts the distal end portion 406 of the blade 404 into the opening 415 and advances the blade 404 through the opening 415 as depicted in FIGS. 15 and 16. As the user does so, a pin 416 (FIGS. 15 and 16) snaps into a pin-receiving recess 417 (FIG. 14) in the first handle 403 to pivotally engage the knife subassembly 401 in the sense that it a allows pivotal movement of the knife subassembly 401 and anvil subassembly 402 relative to each other as indicated by the arrows in FIG. 16. Thus, the first and second subassemblies (i.e., the knife subassembly 401 and the anvil subassembly 402) are adapted to be manually snapped together (assembled) to form a blade-and-anvil cutters and to be manually unsnapped (disassembled) to enable independent use of the knife subassembly 401 as a knife.

Figure 13:
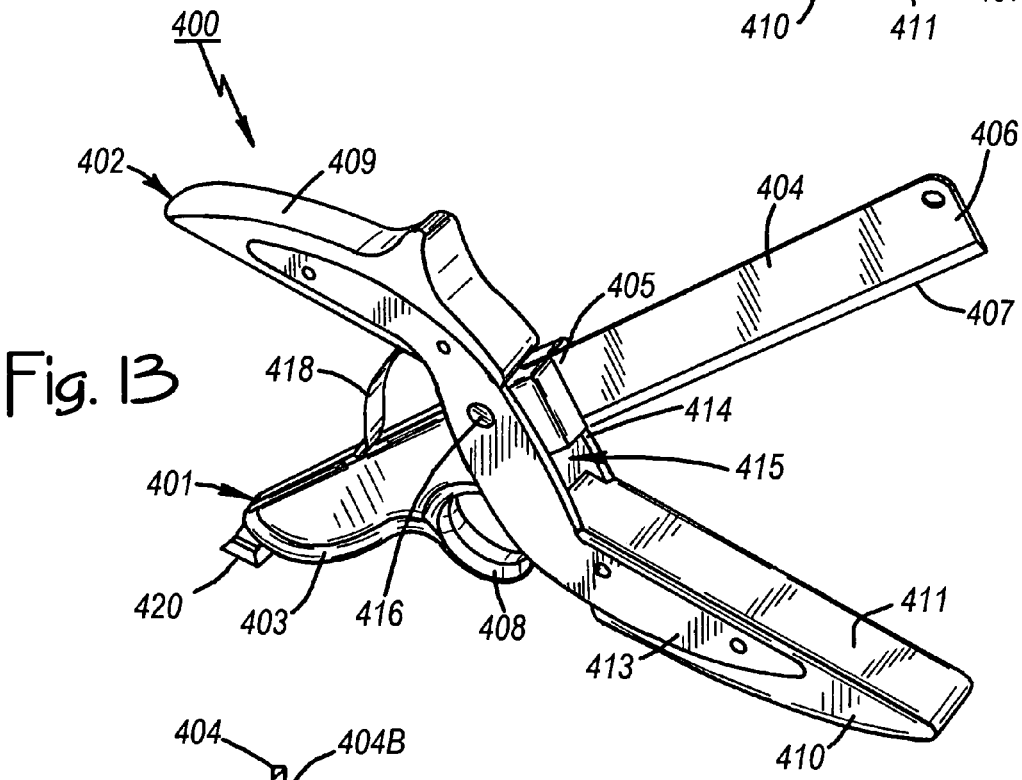
FIG. 13 is an isometric view similar to FIG. 12 except that the blade and anvil of the appliance are in an open position.

A spring 418 (FIGS. 13, 15, and 16) captures a retainer pin 419 (FIGS. 15 and 16) during assembly to spring bias the knife assembly 401 and the anvil subassemblies 402 toward the open position illustrated in FIG. 13. Squeezing the handles 403 and 409 together moves the blade 404 and the anvil 410 to the closed position illustrated in FIG. 12. Actuating a locking mechanism 420 on the first handle 403 of the knife subassembly 401 causes it to engage the second handle 409 on the anvil subassembly 402 in order to hold the knife subassembly 401 and the anvil subassembly 402 of the cutting apparatus 400 in the closed position. In other words, the cutting apparatus 400 includes a locking mechanism 420 that functions as means for holding the subassemblies 401 and 402 in a closed position in which the cutting edge 407 is held against the knife-opposing surface 411 of the anvil 410.

Figure 17:
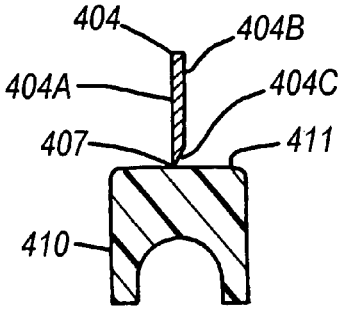
FIG. 17 is a cross sectional elevation view of the blade and anvil taken on line 17—17 of FIG. 16.
Figure 14:
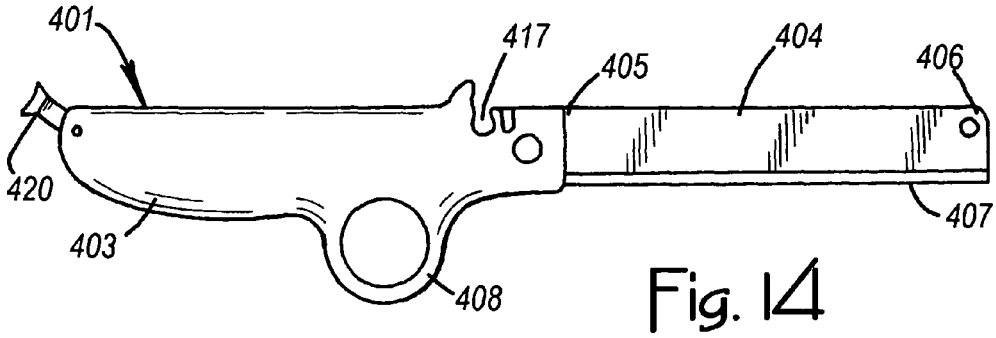
FIG. 14 is a side elevation view of the blade subassembly.

FIG. 17 is a cross sectional elevation view of the blade 404 and the anvil 410 taken on line 17—17 of FIG. 16. The blade 404 includes a flat first side 404A extending to the cutting edge 407 and a beveled second side 404B that includes a beveled portion 404C extending to the cutting edge 407. That arrangement facilitates the slicing of vegetables and other foodstuffs. Thin slices fall away from the beveled second side 404B toward the blade-opposing surface 411.

Thus, the invention of this continuation-in-part application provides refines the convertible knife concept described in the parent application to provide a handheld kitchen scissor/knife appliance for food preparation purposes. A knife subassembly and an anvil subassembly assemble together to form a blade-and-anvil cutting tool configured for food preparation purposes. They disassemble to enable use of the knife subassembly as a conventional fixed-blade knife. Although an exemplary embodiment has been shown and described, one of ordinary skill in the art may make many changes, modifications, and substitutions without necessarily departing from the spirit and scope of the invention.

What is claimed is:

1. A cutting apparatus, comprising: a first subassembly having a first handle and a blade connected to the first handle, the blade including a proximal end portion attached to the handle, a distal end portion, and a cutting edge intermediate the proximal and distal end portions;

a second subassembly having a second handle and a substantially resiliently deformable anvil connected to the second handle; the first and second subassemblies being adapted to be manually snapped together to form a blade-and-anvil cutters and to be manually unsnapped to enable independent use of the first subassembly as a knife;

wherein the second subassembly includes first and second separate and elongated anvil-mounting members that connect the anvil to the second handle there between and at opposite ends thereof, said first and second anvil-mounting members being spaced apart to define a blade-receiving opening intermediate the second handle and the anvil for receiving the first subassembly there through;

wherein the second subassembly includes a pin disposed on a portion thereof that extends across the blade-receiving opening between the first and second anvil-mounting members for joining the separate anvil-mounting members together as a unit;

wherein the first subassembly defines a pin-receiving recess in the first handle such that the action of a user advancing the first subassembly through the blade-receiving opening causes the pin on the second subassembly to be moved radially into the pin-receiving recess in the first handle, such results in the pin on the second subassembly snapping securely into the pin-receiving recess in the first handle in order to pivotally engage the first subassembly and enable use of the first and second subassemblies together as a blade-and-anvil cutters; and wherein the second subassembly does not include a pivot stud of non-circular cross section that passes freely into the pin-receiving recess when the first and second subassemblies are pivoted approximately 135 degrees relative to each other from a normally closed position.

2. A cutting apparatus as recited in claim 1, wherein the first subassembly includes means in the form of a finger-receiving loop for receiving and protecting an index finger of a user.

3. A cutting apparatus as recited in claim 1, wherein the blade includes a flat side extending to the cutting edge and an opposite beveled side extending to the cutting edge.

4. A cutting apparatus as recited in claim 1, further comprising means, including a spring, for spring biasing the first and second subassemblies in an open position such that the cutting edge is spaced apart from the anvil.

5. A cutting apparatus as recited in claim 4, further comprising means, including a locking mechanism, for holding the first and second subassemblies in a closed position in which the cutting edge is held against the anvil.

* * * * *